United States Patent [19]

Sugihara

[11] 4,321,750

[45] Mar. 30, 1982

[54] CHAIN GUIDE FOR A CHAIN SAW

[75] Inventor: Hideo Sugihara, Gifu, Japan

[73] Assignee: Sugihara Rinki Kabushiki Kaisha, Gujo, Japan

[21] Appl. No.: 129,704

[22] Filed: Mar. 12, 1980

[30] Foreign Application Priority Data

Mar. 30, 1979 [JP] Japan ..... 54-42349[U]

[51] Int. Cl.[3] ..... B27B 17/12

[52] U.S. Cl. ..... 30/384; 474/91

[58] Field of Search ..... 30/383, 384, 385, 386, 30/387; 474/45, 91

[56] References Cited

U.S. PATENT DOCUMENTS 2,823,553 2/1958 Harrington ..... 474/91

3,198,223 8/1965 Bowen ..... 30/384 X

FOREIGN PATENT DOCUMENTS 753084 2/1967 Canada ..... 30/385

*Primary Examiner*—Jimmy C. Peters

*Attorney, Agent, or Firm*—Wenderoth, Lind & Ponack

[57] ABSTRACT

A chain saw guide blade includes a pair of side plates between which an axle is fixedly supported and a sprocket is rotatably supported with respect to the axle. The sprocket is rotatable about the axle with roller bearings therebetween for guiding a cutter chain for movement around the edge of the guide blade. A pair of annular seals are respectively disposed between the sprocket and one of the side plates and between the sprocket and the other side plate. Each of the seals includes an annular lip projecting obliquely into resilient contact with a surface of the sprocket or of one of the side plates. A grease-supply aperture in each side plate is normally closed off by a flap on the annular seal or resilient valve placed in a central hole of the axle. When under the pressure of forced grease through the aperture, the flap or valve is resiliently yieldable to allow the grease to be introduced for the lubrication of the roller bearings.

8 Claims, 14 Drawing Figures

CHAIN GUIDE FOR A CHAIN SAW

BACKGROUND OF THE INVENTION

1. Field of the Invention

The present invention relates to a chain guide blade for a chain saw.

2. Prior Art

Usually in accordance with prior art a chain saw guide supports on one end a rotatable sprocket for guiding a cutting chain for moving rapidly around the edge of the guide. The sprocket axle is periodically greased through an access aperture in the side plates of the guide. Since the sprocket is subjected to high temperatures while it is being rotated by the high-speed travel of the chain, the grease on the axle becomes liquified due to the intensive heat and subsequently leaks away, with the result that the sprocket will soon run short of lubricant and therefore seize to the axle. Accordingly, frequent greasing has been necessary for the reliable operation during a prolonged period of time. Furthermore, foreign matter such as sawdust, soil, dirt, or water, often times permeates through spaces between the sprocket and the side plates of the guide, and tends to mix with the grease on the axle. Therefore, the axle, the sprocket, and the roller bearings disposed therebetween are susceptible to mal-functioning and damages due to the affectation of the lubricant by foreign matter.

SUMMARY OF THE INVENTION

According to the present invention, a pair of annular resilient seals are placed one on each side of a cutting chain sprocket and are interposed between the sprocket and one of the side plates of a chain saw guide and between the sprocket and the other side plate, respectively, the sprocket being rotatably supported between the side plates of the guide. The seals prevent leakage of the lubricant from and admission of foreign matter into the bearings, which would otherwise take place through spaces between the sprocket and the side plates. A valve means may be provided in the sprocket axle for normally closing the lubricant-supply aperture to protect against leakage of the lubricant therefrom and admission of foreign matter through the aperture thereto.

An object of the present invention is to provide a chain saw guide having means for sealing the sprocket bearing in the guide against admission therein of sawdust, dirt, soil, rainwater on other foreign matter and leakage of the lubricant grease therefrom.

Another object of the present invention is to provide a chain saw guide blade having a sprocket bearing lubricated at all times with a desired amount of grease without the need for frequent greasing.

Still another object of the present invention is to provide a chain saw guide having a sprocket and its roller bearings free from jamming and seizure due to the presence of foreign matter.

Still another object of the present invention is to provide a chain saw guide which has a prolonged service life.

The above and other objects and advantages of the present invention will become apparent from the following description when taken in conjunction with the accompanying drawings which illustrate certain preferred embodiments by way of example.

DETAILED DESCRIPTION

Figure 1:
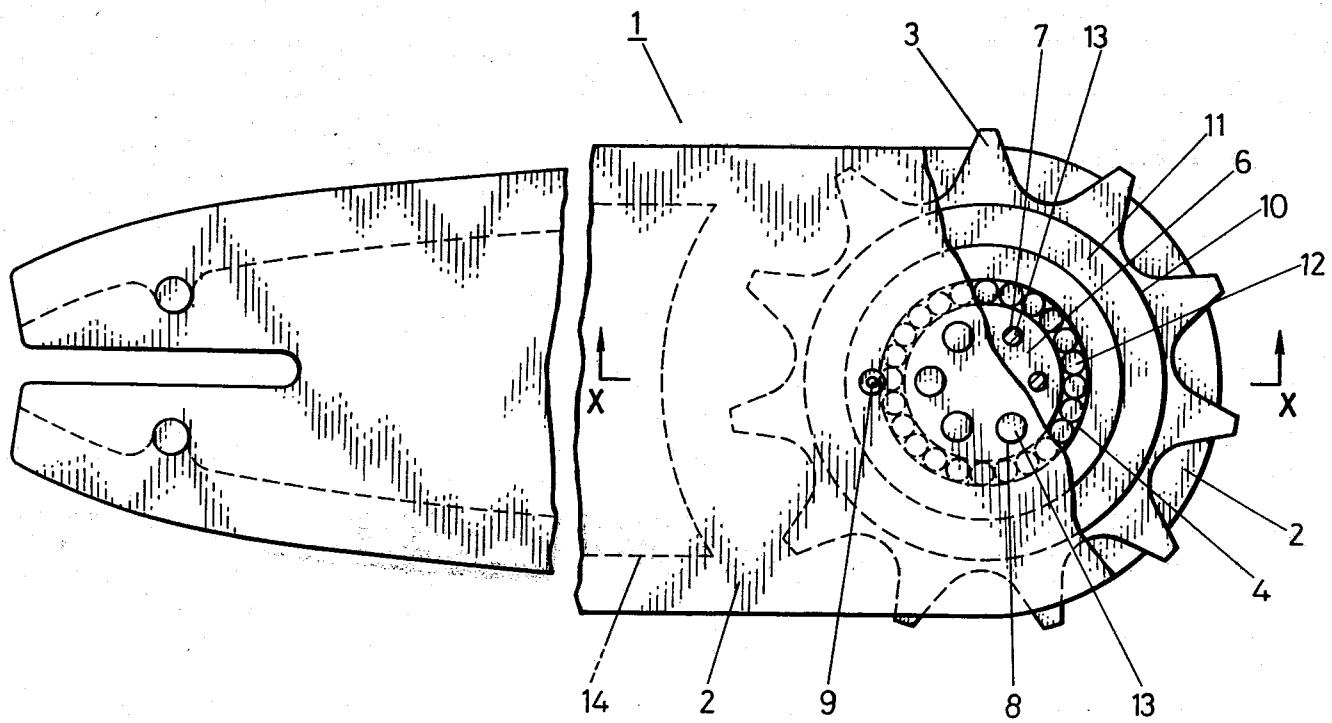
FIG. 1 is a front view, partly broken away, of a chain saw guide in accordance with a first embodiment of the present invention.
Figure 3:
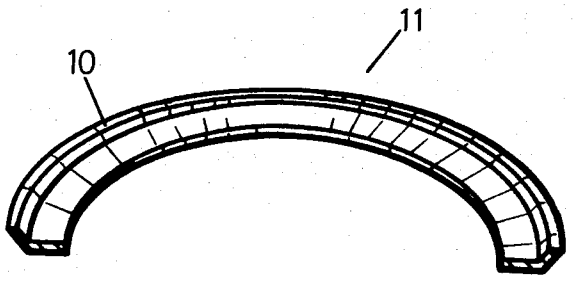
FIG. 3 is a fragmentary perspective view of a seal employed in the guide of FIG. 2.
Figure 2:
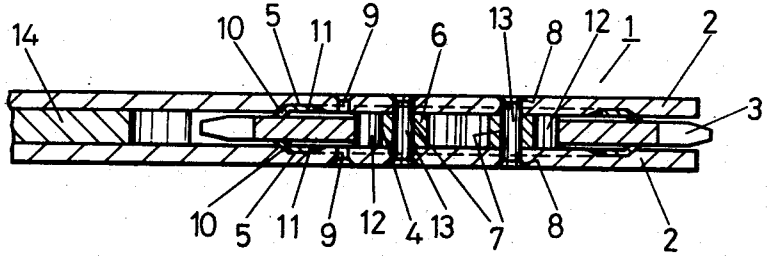
FIG. 2 is a cross-sectional view taken along line X—X of FIG. 1.

In FIGS. 1 through 3, a chain saw guide 1 includes a pair of side plates 2, 2 spaced apart by a spacer 14 and supporting therebetween a rotatable sprocket 3 located at one end of the guide 1. The side plates 2, 2 have in their opposed inner surfaces a pair of respective annular grooves 5, 5 which are concentric with the sprocket 3 and have a diameter greater than that of a central hole 4 of the sprocket 3. The side plates 2, 2 have a plurality of countersunk bores 8 located radially inwardly of the annular grooves 5, 5, the bores 8 respectively being in axial alignment with a plurality of respective rivet holes 7 extending axially through an axle 6 placed in the central hole 4 of the sprocket 3 and interposed between the side plates 2, 2. The side plates 2, 2 also have a pair of access apertures 9, 9, respectively, disposed just radially inwardly of the annular grooves 5, 5 and adjacent to the periphery of the central hole 4.

An annular seal 11 made of a resilient material such as oilproof rubber, plastic or felt is fitted in each of the annular grooves 5, 5, the annular seal 11 including a bottom wall seated in the groove 5 and a lip 10 extending radially outwardly from the bottom wall at an angle with respect to a plane parallel to the surface of the bottom wall. The inclined lip 10 axially projects beyond the inner surface of the side plate 2 into contact with the confronting surface of the sprocket 3. The seal 11 is bonded or otherwise securely mounted in the annular groove 5. Disposed between the axle 6 and the sprocket 3 are a number of roller bearings 12 rotatably positioned around the axle 6. The axle 6 is fixedly positioned between the side plates 2, 2 by a plurality of rivets 13 extending through the countersunk holes 8 in the side plates 2, 2 and through the rivet holes 7 in the axle 6, the ends of the rivets 13 being attached to the side plates 2, 2. Accordingly, the sprocket 3 is rotatable about the axle 6 via the roller bearings 12 for guiding a cutting chain (not shown) for rapid movement around the peripheral edge of the guide 1.

The lubricant or grease is supplied through the access apertures 9, 9 to the rollers 12. The lips 10, 10 of the annular seals 11, 11 are held in resilient sliding contact with the surfaces of the sprocket 3 at all times while the latter is at rest or rotated at high speeds. The grease is thus prevented by the lips 10, 10 from leaking radially outwardly along the surfaces of the sprocket 3. Furthermore, sawdust, dirt, soil, rainwater or other foreign matter is also prevented by the lips 10, 10 from entering through spaces or clearances between the sprocket 3 and the side plates 2, 2.

Figure 5:
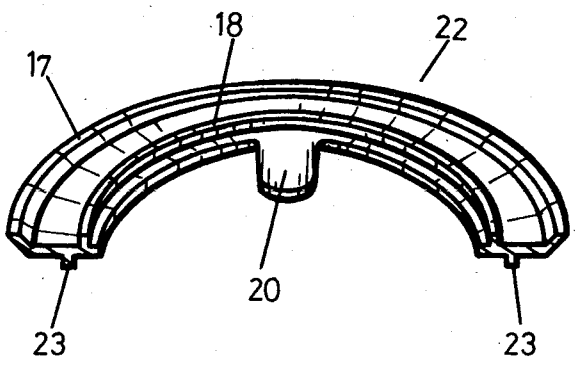
FIG. 5 is a fragmentary perspective view of a seal employed in the guide of FIG. 4.
Figure 4:
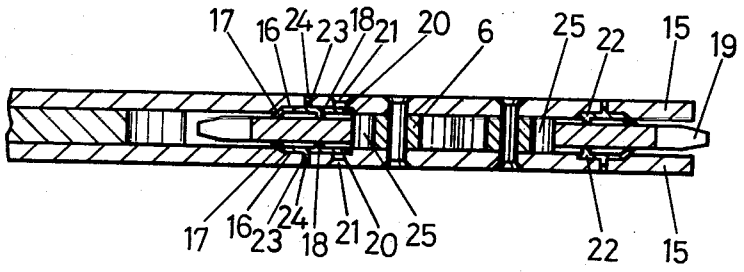
FIG. 4 is a cross-sectional view similar to FIG. 2, showing a chain saw guide according to a second embodiment.

FIGS. 4 and 5 illustrate a chain saw guide blade according to a second embodiment, which is substantially the same as the guide blade shown in FIGS. 1 through 3 except for a pair of annular seals 22, 22. Each of the annular seals 22, 22 is fitted in an annular groove 16 in the inner surface of one of a pair of side plates 15, 15, and has an outer peripheral lip 17 projecting obliquely from and with respect to a bottom wall and outwardly from the groove 16 into resilient abutment with a confronting surface of a sprocket 19. The seal 22 also has an axially projecting annular flange 18 located radially inwardly of the lip 17 and projecting at a right angle as shown or obliquely with respect to the bottom wall into resilient abutment against the sprocket surface. A tongue-shaped flap 20 acting as a valve extends radially inwardly from the seal proper and is normally held against the inner surface of the sprocket 19 to cover a lubricant-supply aperture 21. The seal 22 also includes a plurality of small projections 23 of a circular cross section that extend from the bottom wall of the seal 22 in a direction away from the flange 18. The projections 23 are fitted respectively into a plurality of small holes or notches 24 in the side plate 15 at the annular groove 16, so that the seal 22 is fixedly held against displacement with respect to the side plate 15 even during high-speed rotation of the sprocket 19. When the grease is forced through the access apertures 21, the flap valve 20 resiliently yields and moves out of contact with the side plate 15, allowing the grease to be introduced onto bearing rollers 25.

Figure 7:
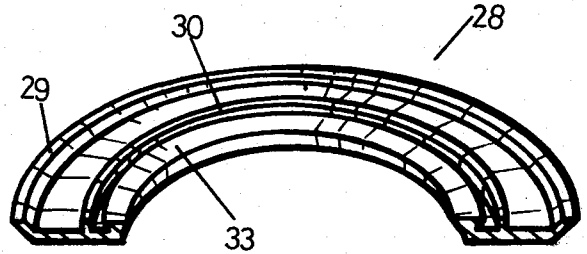
FIG. 7 is a fragmentary perspective view of a seal in the guide shown in FIG. 6.
Figure 6:
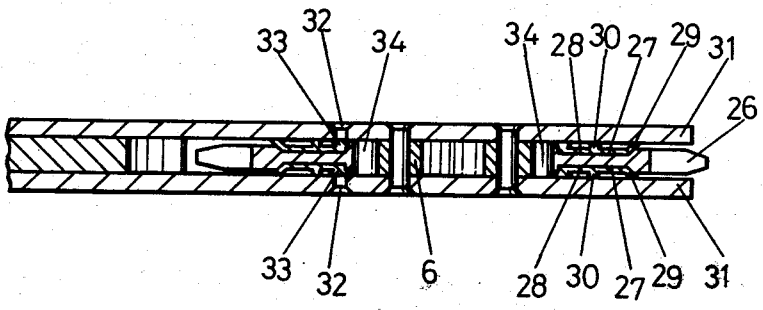
FIG. 6 is a cross-sectional view of a chain saw guide of a third embodiment.

According to a third embodiment shown in FIGS. 6 and 7, a chain sprocket 26 has in its opposite surfaces a pair of relatively shallow annular grooves 27, 27 that are concentric with the sprocket 26 and face toward the inner opposed surfaces of a pair of side plates 31, 31 of a chain saw guide. An annular seal 28 is fitted in each of the annular grooves 27, 27 and includes an outer peripheral lip 29 projecting obliquely from the annular groove 27 and is held resiliently against the confronting inner surface of the side plate 31. The seal 28 also includes an annular flange 30 located radially inwardly of the lip 29 and projects at a right angle as shown or obliquely with respect to the plate 31 into resilient abutment against the side plate 31. The seal 28 further has an annular flange 33 acting as a valve located radially inwardly of the annular flange 30 and normally held resiliently against the inner surface of the side plate 31 for closing off one of a pair of grease apertures 32, 32 in the side plates 31, 31. Pressurized grease introduced through the aperture 32 causes the valve 33 to resiliently yield thereby, opening the aperture 32 to allow roller bearings 34 to be greased.

Figure 9:
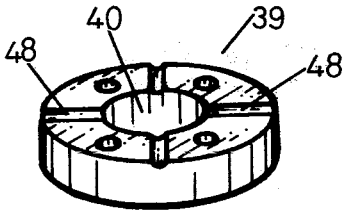
FIG. 9 is a perspective view of a fixed axle utilized in the guide of FIG. 8.
Figure 8:
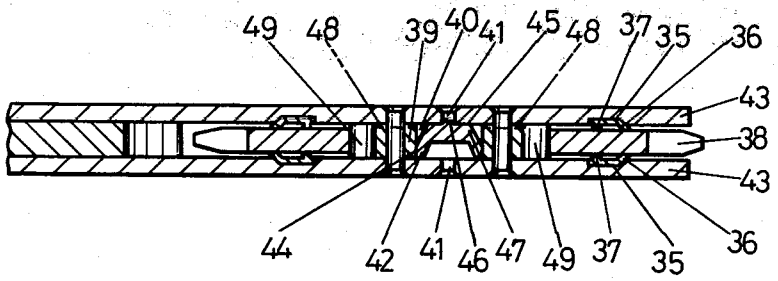
FIG. 8 is a cross-sectional view of a chain saw guide according to a fourth embodiment.

As shown in FIG. 8, a chain saw guide constructed in accordance with the present invention has a pair of grease apertures 41, 41 respectively in a pair of side plates 43, 43 and in concentric relation with a sprocket 38 or with an axle 39 having a central bore 40. A pair of seals 35, 35 are substantially the same as the seals 22, 22 shown in FIGS. 4 and 5 except that each seal 35 has no flap valve for normally closing the grease aperture. Each of the seals 35, 35 has an outer peripheral lip 36 and a radially inward flange 37 held resiliently against the confronting surface of the sprocket 38 for preventing grease leakage and admission of any foreign matter. A cup-shaped valve 47 of a circular cross section is disposed in the central bore 40 of the axle 39, the valve 47 being made of a resilient material such as oilproof rubber, plastic, or felt. The cup-shaped valve 47 comprises an annular end 42 held in contact with the inner surface of one of the side plates 43, 43 in surrounding relation to the aperture 41, an outer peripheral surface 44 held against the inner peripheral surface defining the central bore 40 of the axle 39, and a closed bottom end or surface 45 held against the inner surface of the other side plate 43. The bottom end 45 has a small central axial projection 46 of a circular cross section for normally projecting into the aperture 41 in said other side plate 43 to close it off. When grease is pressurized into the aperture 41 which the projection 46 normally closes off, the bottom end of the valve 47 is pushed resiliently off the inner surface of the side plate 43, whereupon the projection 46 is retracted from its aperture-closing position, permitting the grease to be introduced through the aperture 41 and to flow over the bottom end of the valve 47. The axle 39 has in its one axial end a plurality of radial slots 48 (FIG. 9) angularly or circumferentially spaced from each other. The grease is supplied to roller bearings 49 disposed around the axle 39 by flowing thereto through the slots 48. With such an arrangement, the grease can be introduced only through one of the apertures 41, 41 inasmuch as the other aperture 41 is surrounded by the annular end 42 of the valve 47 past which no grease is allowed to flow.

Figure 11:
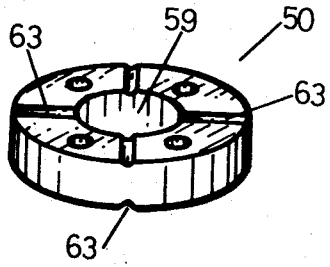
FIG. 11 is a perspective view of a fixed axle in the guide of FIG. 10.
Figure 10:
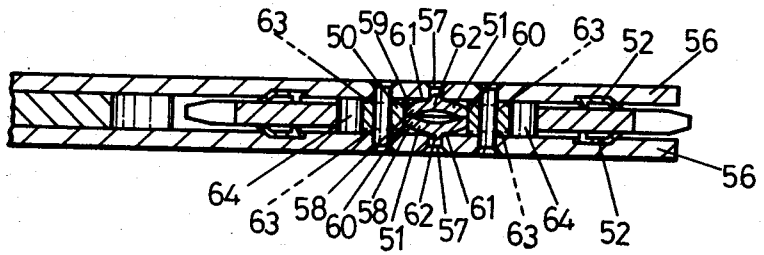
FIG. 10 is a cross-sectional view of a chain saw guide of a fifth embodiment.

FIG. 10 shows a fifth embodiment of chain saw guide blade which is equipped with a pair of dish-shaped valves 51, 51. The structure and function of a pair of annular seals 52, 52 is the same as that of the seals 35, 35 illustrated in FIG. 8, and therefore needs no further description. The valves 51, 51 are made of a resilient material such as oilproof rubber, plastic, or felt and are placed in confronting relation in a central bore 59 of an axle 50, with annular edges or axial inner surfaces 58, 58 of the valves 51, 51 being held in abutment against each other. Each of the valves 51, 51 includes a radially outer peripheral surface 60 held in contact with the inner peripheral surface defining the central bore 59 of the axle 50, a bottom or axial outer surface 61 held against the inner surface of one of a pair of side plates 56, 56, and a small axial projection 62 of a circular cross section provided centrally on the bottom surface 61 for normally closing off one of a pair of grease-supply apertures 57, 57 respectively in the side plates 56, 56. The axle 50 has in each of its axial ends a plurality of radial slots 63 (FIG. 11) that allows grease to flow past the axle 50 toward bearing rollers 64 disposed around the axle 50. According to the fifth embodiment, either of the valves 51, 51 is yieldable under pressure of the grease, and therefore the grease can be supplied through either of the apertures 57, 57.

Figure 12:
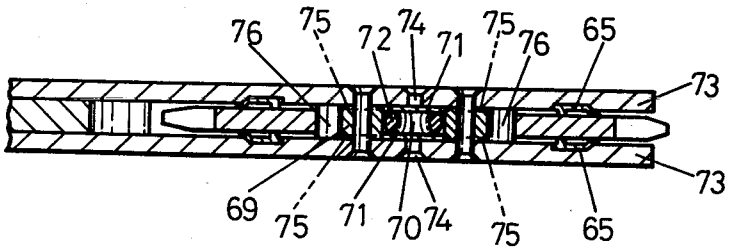
FIG. 12 is a cross-sectional view of a chain saw guide in accordance with a sixth embodiment.

According to a sixth embodiment of FIG. 12, a valve mechanism mounted in a central bore 70 of an axle 69 comprises a pair of spaced disks 71, 71 made of metal or plastic, and an annular member 72 of rubber such as an "O"-ring interposed between the disks 71, 71. The disks 71, 71 are normally held in contact with the inner surfaces of a pair of side plates 56, 56 to close off a pair of grease apertures 57, 57 respectively in the side plates 56, 56, thereby preventing grease leakage and admission of dust, water, etc. through the apertures 57, 57. Grease supplied through one of the apertures 74 under pressure pushes the corresponding disk 71, with the rubber ring 72 being resiliently compressed, and is introduced through the slats 75 in the axle 69 toward roller bearings 76 via the apertures 74. A pair of annular seals 65, 65 are identical in structure and function with the seals 35, 35 shown in FIG. 8.

Figure 13:
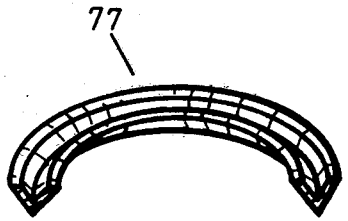
FIGS. 13 and 14 are fragmentary perspective views of other seals according to the present invention.
Figure 14:
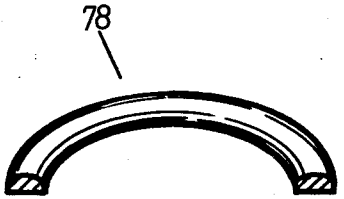

Other seal forms may also be used. For example, an annular seal 77 of a V-shaped cross section as illustrated in FIG. 13, or an annular seal 78 of a semicircular cross section may be employed in a chain saw guide according to the present invention. Furthermore, the sprockets shown and described can be replaced with rotatable disks.

While certain preferred embodiments have been shown and described in detail, it should be understood that many changes and modifications may be made therein without departing from the spirit and scope of the present invention and the appended claims.

What is claimed is:

1. A chain guide for a chain saw comprising:

a pair of axially spaced side plates;

a cutting chain sprocket rotatably supported between said side plates and having a central hole axially extending therethrough;

an axle positioned within said central hole for rotatably accommodating said sprocket therearound;

the sides of said side plates facing one another respectively each having an annular groove therein, the annular grooves being concentric with and having a diameter greater than said central hole;

each of said side plates having an aperture therethrough located radially outwardly from the radial outer periphery of said axle and radially inwardly of said annular groove for supplying lubricant to said chain guide;

a pair of dish-shaped annular resilient seals, each respectively positioned in one of the annular grooves and having a radially outwardly extending and inclined annular lip for sealingly and slidably contacting the corresponding surface of said sprocket for maintaining lubricant within said chain guide.

2. A chain guide for a chain saw comprising:

a pair of axially spaced side plates;

a cutting chain sprocket rotatably supported between said side plates and having a central hole axially extending therethrough;

an axle positioned within said central hole for rotatably accommodating said sprocket therearound;

the sides of said sprocket respectively facing said side plates respectively each having an annular groove therein, the annular grooves being concentric with and having a diameter greater than said central hole;

each of said side plates having an aperture therethrough located radially outwardly from the radial outer periphery of said axle and radially inwardly of the annular grooves for supplying lubricant to said chain guide;

a pair of dish-shaped annular resilient seals, each respectively positioned in one of the annular grooves and having a radially outwardly extending and inclined annular lip for sealingly and slidably contacting the corresponding surface of the corresponding one of said side plates for maintaining lubricant within said chain guide.

3. A chain guide for a chain saw comprising:

a pair of axially spaced side plates;

a cutting chain sprocket rotatably supported between said side plates and having a central hole axially extending therethrough;

an axle positioned with said central hole for rotatably accommodating said sprocket therearound and having a central bore therethrough;

the sides of said side plates facing one another respectively each having an annular groove therein, the annular grooves being concentric with and having a diameter greater than said central hole;

each of said side plates having an aperture therethrough located radially inwardly of the periphery of said central bore and communicating with said central bore for supplying lubricant to said chain guide; and a pair of dish-shaped annular resilient seals, each respectively positioned in one of the annular grooves and having a radially outwardly extending and inclined annular lip for sealingly and slidably contacting the corresponding surface of said sprocket for maintaining lubricant within said chain guide.

4. A chain guide for a chain saw comprising:

a pair of axially spaced side plates;

a cutting chain sprocket rotatably supported between said side plates and having a central hole axially extending therethrough;

an axle positioned within said central hole for rotatably accommodating said sprocket therearound and having a central bore therethrough;

each of said side plates having an aperture therethrough located radially inwardly of the outer periphery of said central bore and communicating with said central bore for supplying lubricant to said chain guide;

a pair of annular resilient seals, said seals respectively having a diameter greater than said central hole and respectively positioned between a side of one of said side plates and a side of said sprocket and respectively concentrically aligned with said sprocket for maintaining lubricant within said chain guide; and a resilient cup-shaped valve fixedly positioned within said central bore and having a bottom surface abutting a side of one of said side plates, said bottom surface having an axial projection extending into and closing one of the apertures for maintaining lubricant within said chain guide and for, when pressurized lubricant is supplied to said one of said apertures, flexing axially inwardly toward said axle and opening said one of said apertures for admitting lubricant into said chain guide.

5. A chain guide for a chain saw comprising:

a pair of axially spaced side plates;

a cutting chain sprocket rotatably supported between said side plates and having a central hole axially extending therethrough;

an axle positioned within said central hole for rotatably accommodating said sprocket therearound and having a central bore therethrough;

each of said side plates having an aperture therethrough located radially inwardly of the outer periphery of said central bore and communicating with said central bore for supplying lubricant to said chain guide;

a pair of annular resilient seals, said seals respectively having a diameter greater than said central hole and respectively positioned between a side of one of said side plates and a side of said sprocket and respectively being concentrically aligned with said sprocket for maintaining lubricant within said chain guide; and a pair of resilient dish-shaped valves oppositely positioned within said central bore, each of said valves respectively having an axial inner surface and the inner surfaces abutting one another for fixedly positioning said valves, each of said valves respectively having an axial outer surface and the outer surfaces respectively abutting a side of one of said side plates and closing one of said apertures for maintaining lubricant within said chain guide and for, when pressurized lubricant is supplied to said one of said apertures, flexing axially inwardly toward said axle for opening said one of said apertures for admitting lubricant into said chain guide.

6. A chain guide for a chain saw comprising:

a pair of axially spaced side plates;

a cutting chain sprocket rotatably supported between said side plates and having a central hole axially extending therethrough;

an axle positioned within said central hole for rotatably accommodating said sprocket therearound and having a central bore therethrough;

each of said side plates having an aperture therethrough located radially inwardly of the outer periphery of said central bore and communicating with said central bore for supplying lubricant to said chain guide; and a pair of annular resilient seals, said seals respectively having a diameter greater than said central hole and respectively positioned between a side of said side plates and a side of said sprocket and respectively being concentrically aligned with said sprocket for maintaining lubricant within said chain guide; and a valve positioned within said central bore, said valve including a resilient annular member and a pair of disk members, each of said disk members respectively abutting a side of one of said side plates and closing one of said apertures for maintaining lubricant within said chain guide, said annular member being axially positioned between and abutting said disk members for positioning said disk members for closing said apertures and for, when pressurized lubricant is supplied to one of said apertures and against one of said disk members, axially inwardly compressing for allowing pressurized lubricant to move said one of said disk members thereby admitting lubricant into said chain guide.

7. A chain guide for a chain saw comprising:

a pair of axially spaced side plates;

a cutting chain sprocket rotatably supported between said side plates and having a central hole axially extending therethrough;

an axle positioned within said central hole for rotatably accommodating said sprocket therearound and having a central bore therethrough;

the sides of said side plates facing one another respectively each having an annular groove and a plurality of notches therein, the annular grooves being concentric with and having a diameter greater than said central hole, the notches of each side plate respectively communicating with and axially extending from the annular groove thereof;

each of said side plates having an aperture therethrough located radially outwardly from the radial outer periphery of said axle and radially inwardly of said annular groove for supplying lubricant to said chain guide;

a pair of annular resilient seals, each of said seals respectively positioned in one of said annular grooves for sealingly and slidably contacting the corresponding surface of said sprocket for maintaining lubricant within said chain guide; and each of said seals having a plurality of projections, each of said projections respectively engaging one of said notches for fixing the corresponding seal to the corresponding side plate.

8. A chain guide as claimed in claims 4 or 5, wherein the axial outer surfaces of said axle have a plurality of slots radially extending from the central bore thereof to the outer periphery thereof for supplying lubricant to said sprocket.

* * * * *